US006886913B2

(12) United States Patent
Nishiberi

(10) Patent No.: US 6,886,913 B2
(45) Date of Patent: May 3, 2005

(54) RECORDING APPARATUS

(75) Inventor: Nozomu Nishiberi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/073,970

(22) Filed: Feb. 14, 2002

(65) Prior Publication Data

US 2002/0113841 A1 Aug. 22, 2002

(30) Foreign Application Priority Data

Feb. 20, 2001 (JP) ..... 2001/043461

(51) Int. Cl.[7] ..... B41J 2/14; B41J 2/16; B41J 23/00

(52) U.S. Cl. ..... 347/50; 347/37; 347/49

(58) Field of Search ..... 347/49, 50, 37

(56) References Cited

U.S. PATENT DOCUMENTS 5,880,754 A 3/1999 Niikura et al.
6,280,017 B1 * 8/2001 Miyauchi ..... 347/49
6,435,662 B1 * 8/2002 Kline et al. ..... 347/49
6,501,663 B1 * 12/2002 Pan ..... 361/779

FOREIGN PATENT DOCUMENTS

JP 2000-198190 * 7/2000

* cited by examiner

*Primary Examiner*—Michael S. Brooke
(74) *Attorney, Agent, or Firm*—Fitzpatrick, Cella, Harper & Scinto

(57) ABSTRACT

A recording apparatus for recording on a recording material by use of a recording head comprises a carriage for mounting a recording head, and a pressurized connector fixed to the carriage for electrically connecting the recording head mounted on the carriage with a control circuit, which is fixed to the wall face opposite to the recording head mounted on the carriage, hence making it possible to reliably fix the recording head to the carriage with a smaller number of parts with a simple and inexpensive structure, while receiving the contact pressure of the pressurized connector with the robustness of the carriage entire body, and to provide an ink jet recording apparatus to be able to attempt making the carriage smaller and lighter.

6 Claims, 14 Drawing Sheets

RECORDING APPARATUS

BACKGROUND OF THE INVENTION

1. Field of the Invention

The present invention relates to a recording apparatus that performs recording on a recording material by use of a recording head mounted on a carriage.

2. Related Background Art

The carriage structure of the conventional recording apparatus has been often such as to provide a base plate (head base plate) or an FPC having the conductively exposed portion that does not present resist to the recording head side in order to electrically couple the recording head and the recording apparatus main body, and then, to provide a pressurized connector for the carriage that mounts the recording head for coupling electrically with the conductively exposed portion of the recording head. This pressurized connector is usually pressed to be in contact with the conductively exposed portion of the recording head by use of the elastic deformation of a plated metal. Further, a pressurized connector of the kind is soldered to a base plate (carriage base plate) mounted on the carriage, and then, the base plate on the carriage is electrically coupled with the circuit board (control circuit) on the apparatus main body side through an FFC or an FPC.

FIG. 15 is a vertically sectional view that shows schematically the example of the carriage structure of the conventional recording apparatus. In FIG. 15, a reference numeral 500 designates a recording head and 510, a carriage. For the recording head 500 on the carriage side, a conductively exposed portion 500A is provided. For the carriage 510, the pocket portion 510A for mounting the recording head is formed, and the recording head 500 is inserted into the recording head pocket portion and positioned by use of a lever (not shown) on a designated position of the carriage 510. Also, for the carriage 510, the hole (opening portion) 510B for use of the pressurized connector is formed. For the pressurized connector 520, there is provided the pressurized pin 520A that serves as the metal elastic member for securing the electrical contact with the recording head 500.

With the structure shown in FIG. 15, the pressurized connector 520 is fixed to the carriage base plate 530. The carriage base plate 530 is tightly fixed to the outer wall face of the carriage 510, that is, the wall face on the side opposite to the side of the carriage 510 that faces the recording head 500, by use of a screw 550. In accordance with the example shown in FIG. 15, the carriage base plate 530 is tightly fixed by the utilization of the screw fixing portion 510C on the wall face on the side opposite to the side that faces the recording head 500. In this respect, the pressurized pin 520A of the pressurized connector 520 is soldered to the face on the opposite side of the carriage base plate 530 to be electrically connected with the base plate on the apparatus main body side through the carriage base plate and the FFC 540. In this way, the carriage base plate 530 of the conventional carriage structure is fixed to the carriage 510 by means of the screw 550 from the opposite side of the recording head 500 with respect to the wall face as shown in FIG. 15.

However, with the conventional carriage structure of the recording apparatus as shown in FIG. 15, there are technical problems yet to be solved as given below.

For example, the number of the pressurized pins 520A of the pressurized connector 520 is approximately 40, and assuming that the maximum load per pin is 100 g, a load of maximum 4 kg should be exerted on the pressure connector 520 as a whole. Then, the screw 550 should receive the entire load of maximum 4 kg eventually. In this case, since the carriage 510 is formed of plastic, a self-tap screw should be used as the screw 550 to fix the connector and carriage, or there is a need for the formation of a metal tap on the carriage 510 side. In any case, in order to secure the strength of the screw fixing portion 510C of the carriage 510, it is necessary to make the gap L1 between the upper and lower screw fixing portions 510 large to a certain extent. This becomes an unfavorable factor when making the carriage 510 smaller.

Also, regarding the entire strength of the carriage 510, there is a need for the reinforcement of some other parts by the amount equivalent to the extent the strength is lowered due to the formation of the hole (opening) 510B on the carriage 510 for use of the pressurized connector 520. This also becomes an unfavorable factor when making the carriage 510 smaller and lighter.

Further, if it is intended to form the head installation pocket 510A of the carriage 510 and the carriage base plate fixing portion 510D integrally, the configuration of the carriage 510 becomes complicated as clear form the structure shown in FIG. 15. This presents disadvantage in terms of the manufacturing costs.

SUMMARY OF THE INVENTION

It is an object of the present invention to provide a recording apparatus structured simply with a lesser number of components at lower costs, being capable of fixing the recording head reliably on the carriage thereof, and designed to make the carriage smaller and lighter with the arrangement for receiving the contact presure of the pressurized connector to be in contact with the recording head under pressure.

It is another object of the invention to provide a recording apparatus provided with a carriage to mount a recording head for recording by discharging ink, and a pressurized connector installed on the carriage for electrically connecting the recording head mounted on the carriage with a control circuit, and the pressurized connector is installed on the wall face that faces the recording head mounted on the carriage.

DETAILED DESCRIPTION OF THE PREFERRED EMBODIMENTS

Hereinafter, in conjunction with the accompanying drawings, the detailed description will be made of the embodiments in accordance with the present invention. In this respect, the same part or the corresponding part thereto is designated by the same reference mark in each of figures.

Figure 1:
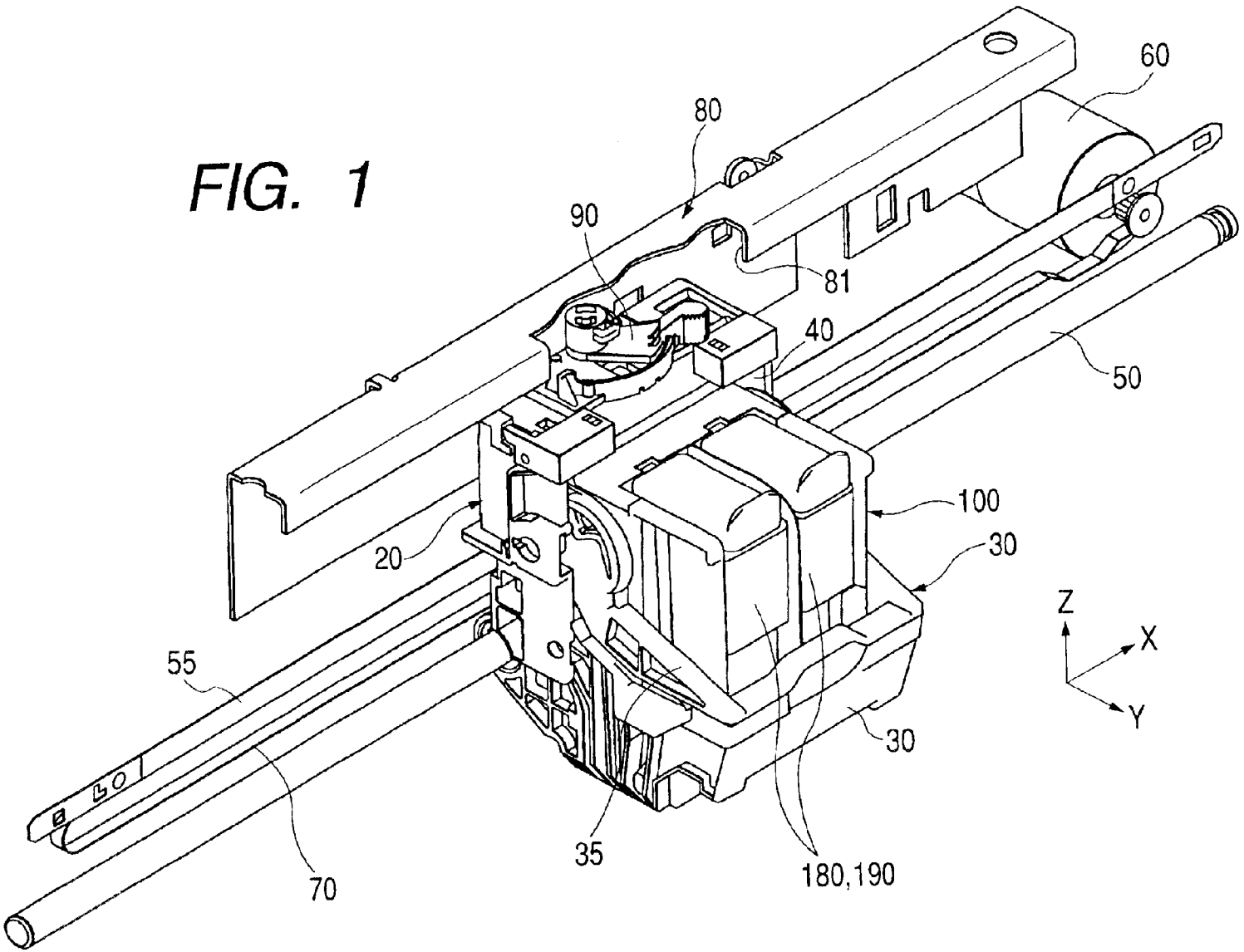
FIG. 1 is a perspective view that schematically shows the principal part of an ink jet recording apparatus in accordance with one embodiment of the recording apparatus of the present invention.

FIG. 1 is a perspective view that schematically shows the principal part of an ink jet recording apparatus in accordance with one embodiment of the recording apparatus of the present invention.

In FIG. 1, a reference numeral 100 designates a recording head serving as recording means, and for the present embodiment, the recording head 100 is of a separate tank type with the ink jet recording head and ink tank being separate bodies; 20, the carriage that mounts the recording head 100 and reciprocates in the main scanning directions; 30, the carriage cover that guides the recording head 100 to the setting position on the carriage 20, while hiding (for the prevention of exposure) the carriage 20 and the base plate of the recording head 100 (the carriage base plate 40 and the head base plate 110); 35, the set lever that effects the detachment and attachment of the recording head 100; 50, a guide shaft for guiding and supporting the movement of the carriage 20; 60, a carriage motor serving as the driving source of the carriage 20; and 70, the timing belt that serves as transmission means for transmitting the driving power of the carriage motor 60 to the carriage 20.

Also, for the present embodiment, a DC motor is used as the carriage motor 60. Therefore, a linear encoder 45 for detecting the carriage position is installed on the carriage base plate 40 fixed to the carriage 20 (see FIG. 6). In FIG. 1, a reference numeral 55 designates the linear scale that becomes the scale portion of the linear encoder 45. The linear scale 55 is fixed to the chassis 80 of the apparatus main body. Also, the chassis 80 has a guide rail 81 formed integrally therewith. Then, the structure is arranged to enable the gap adjustment lever 90 (for adjusting the gap between the recording head and the surface of a recording material such as paper sheet) installed on the upper face of the carriage 20 to smoothly move (slide) in a state of being in contact with the guide rail 81.

The recording apparatus of the present embodiment is the ink jet recording apparatus using serial method (of serial type), and while moving the carriage 20 in the main scanning direction, the recording head 100 is driven in accordance with recording information for the execution of recording on a recording material. With the performance of one-line recording per main scan, the recording sheet is fed by a designated pitch (sub-scanned), and, the next one-line portion is recorded. Thereafter, this operation is repeated to complete recording on the recording material entirely.

Now, hereunder, the detailed description will be made of the structure of the recording head 100 and carriage 20 in accordance with the present embodiment.

Figure 2:
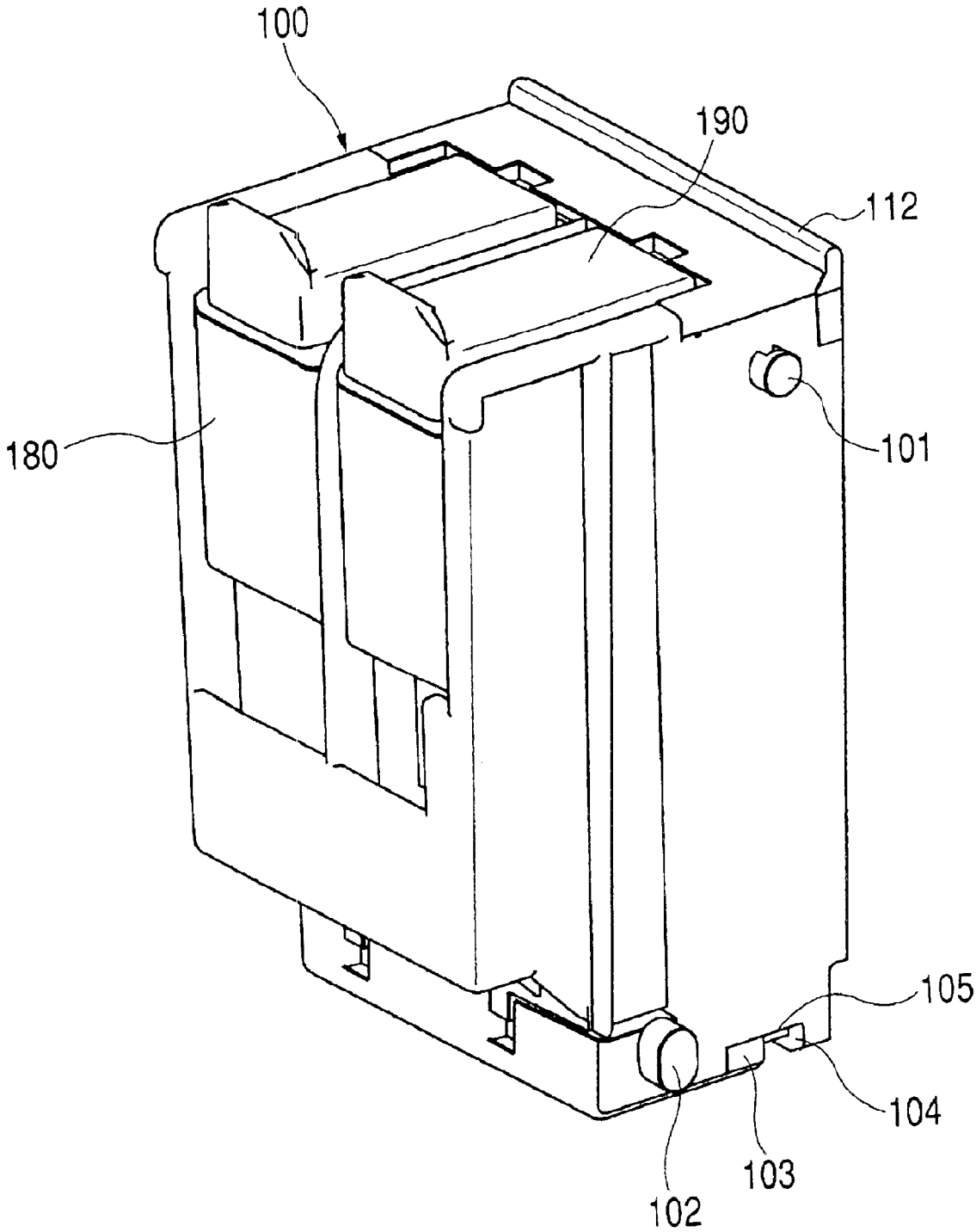
FIG. 2 is a perspective view that schematically shows the recording head represented in FIG. 1, observed from the outer side (backside) thereof.
Figure 3:
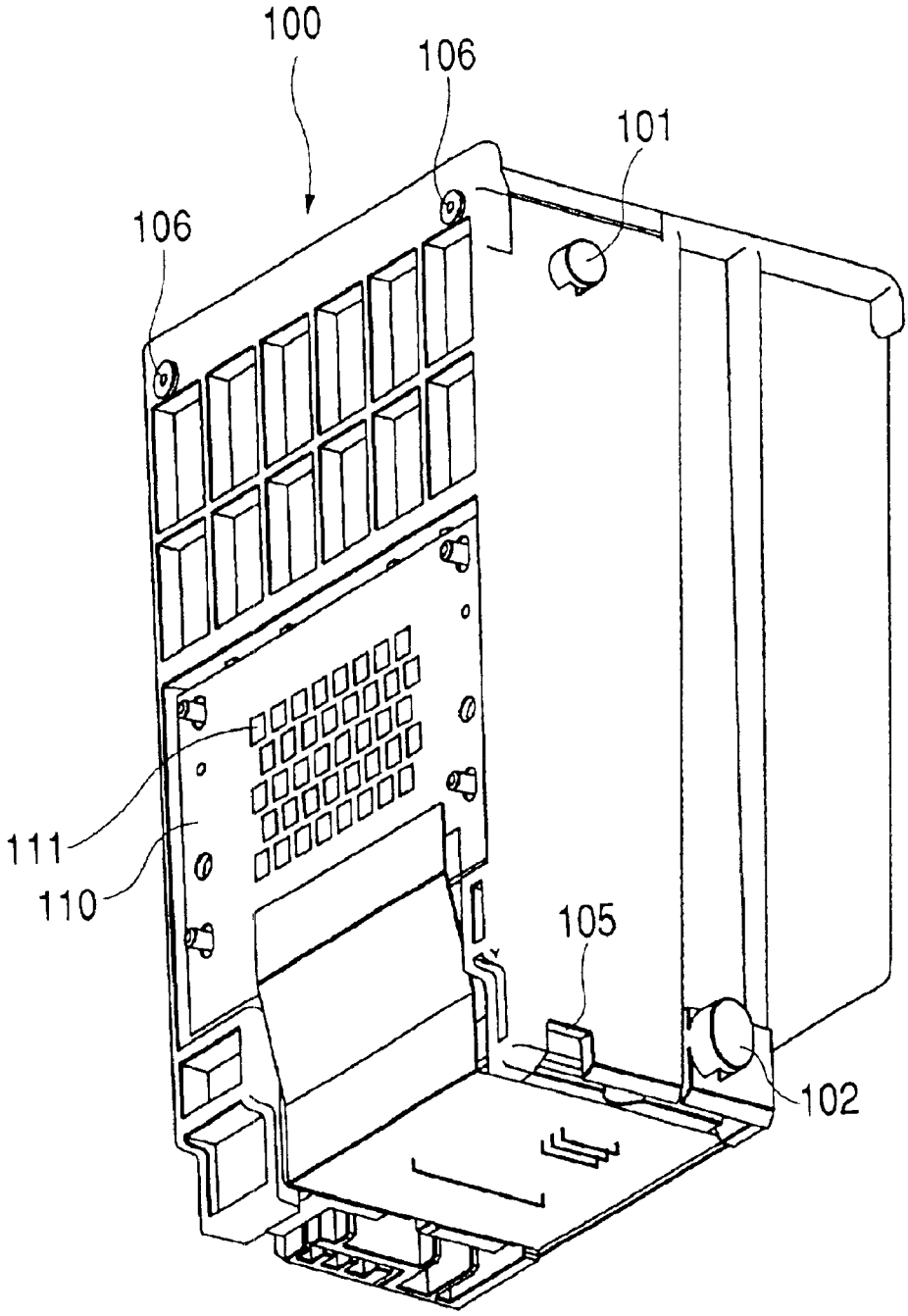
FIG. 3 is a perspective view that schematically shows the inner side of the recording head represented in FIG. 1, observed from the inner side (rear side) thereof.

FIG. 2 is a perspective view that schematically shows the recording head 100 represented in FIG. 1, observed from the outer side (back side, front side) thereof. FIG. 3 is a perspective view that schematically shows the inner side of the recording head 100 represented in FIG. 2, observed from the inner side (rear side) thereof. In FIG. 2 and FIG. 3, a reference numeral 180 designates a color ink tank. In this ink tank 180, ink of three colors, Y (yellow), M (magenta), and C (cyan), is retained in the same housing by use of partitions, respectively. A reference numeral 190 designates an ink tank for black ink. The color ink tank 180 and the black ink tank 190 are exchangeable individually, and when ink is no longer present, each individual color ink tank 180 and black ink tank 190 or both of them can be freely replaced without removing the recording head 100 from the recording apparatus main body.

On both sides of the recording head 100, bosses 101 are installed to engage with the cam surface 35C (FIG. 8) of the head set lever 35, which will be described later, in order to set the recording head in the carriage 20. The bosses 101 are configured symmetrically on the left and right sides.

Also, on both sides of the lower part of the recording head 100, there are formed elongated round bosses 102, respectively, that slidably engage with groove portions 30A formed on both sides of the carriage cover 30 as guiding portions setting the recording head to the carriage 20, which will be described later. The elongated round bosses 102 are formed symmetrically both on the left and right sides. Here, a reference numeral 103 designates the abutting surface for positioning the recording head 100 on the carriage 20 in the direction X (left and right directions, main scanning direction), this abutting surface 103 is provided only for one side.

Further, on both sides of the lower part of the recording head 100, there are provided an abutting surface 104 used for positioning in the direction Y (+) (forward and backward directions, sub-scanning direction) by abutting against the face 20F (FIG. 7) of the carriage 20, and an abutting surface 105 used for positioning in the direction Z (upward and downward directions) by abutting against the face 20E (FIG. 7) of the carriage 20. Also, on the upper part of the recording head 100, the rib 112 is formed, which is hooked by use of a flat spring 21 to be described later. This rib 112 holds the recording head 100 at a designated position when the flat spring 21 fixed to the carriage 20 hooks to engage therewith.

Figure 7:
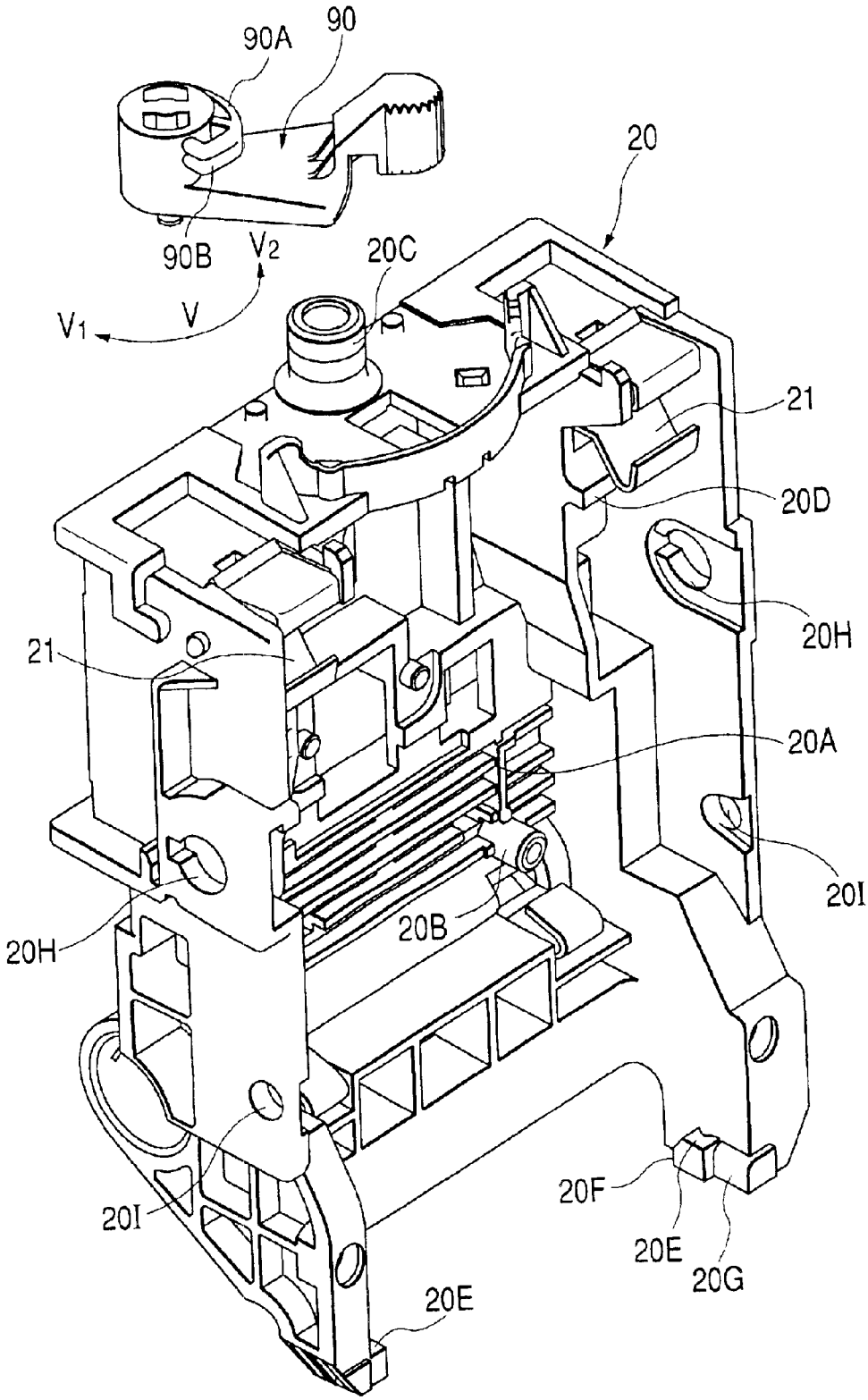
FIG. 7 is a perspective view that schematically shows the structure of the carriage represented in FIG. 1.

In FIG. 2 and FIG. 3, there is provided an abutting surface 106 used for positioning in the direction Y (–) (forward and backward directions, sub-scanning direction) by abutting against the face 20D of the carriage 20 at two locations, left and right, on the upper part of the back face of the recording head 100 (FIG. 7).

Also, on the back face of the recording head 100, the head base plate 110 is provided for use of electrical connection. This head base plate 110 is provided with the conductively exposed portion (hereinafter referred to as a contact face) 111, which has no resist treatment. In this respect, there are arranged 40 contacts on the contact face 111, for example.

To the recording head 100, ink retained in the ink tanks 180 and 190 is supplied. The recording head 100 is an ink jet recording head for discharging ink from plural discharge ports selectively when energy is applied in accordance with recording signals. Also, the recording head 100 is ink jet recording means for discharging ink by the utilization of thermal energy, which is provided with electrothermal converting element for generating thermal energy. Further, the recording head 100 discharges ink from discharge ports for recording by the utilization of pressure changes resulting from the growth and shrinkage of bubble brought about by film boiling generated by thermal energy applied by means of the electrothermal converting element. Therefore, the electrothermal converting element is provided for each of the discharge ports correspondingly, and ink is discharged from the corresponding discharge port by the application of pulse voltage to the corresponding electrothermal converting element in accordance with recording signals.

Figure 4:
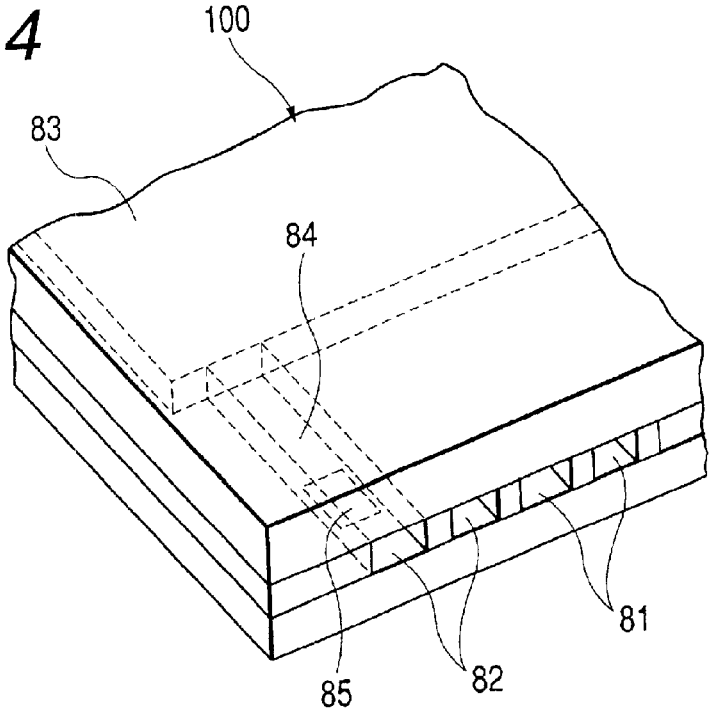
FIG. 4 is a partial perspective view that schematically shows a part of the ink discharge unit of the recording head represented in FIG. 1.

FIG. 4 is a partial perspective view that schematically shows the structure of the ink discharge portion (one discharge port array) provided for the recording head 100 serving as recording means. In FIG. 4, for the discharge port surface 81, which faces a recording material, such as a recording sheet, with a designated gap (approximately 0.3 mm to 2.0 mm, for example), there are formed plural discharge ports 82 at designated pitches. Then, an electrothermal converting element (heat generating resistive element or the like) 85 to generate energy for ink discharge is arranged along the wall face of each liquid path 84 communicated with a common liquid chamber 83 and each discharge port 82. The recording head 100 is positioned and fixed to the carriage 20 in such a positional relationship that the discharge ports 82 are arranged in line in the direction intersecting with the main scanning movement direction (that is, the traveling direction of the carriage 20 in a case of being mounted on the carriage 20 as in the present embodiment, the direction indicated by an arrow X). Thus, the recording head 100 is structured to drive the corresponding electrothermal converting element 85 (by the application of pulse voltage) in accordance with image signals or discharge signals to cause film boiling in ink in the liquid path 84, and discharge ink from the corresponding discharge port 82 by means of pressure thus exerted at that time.

Figure 5:
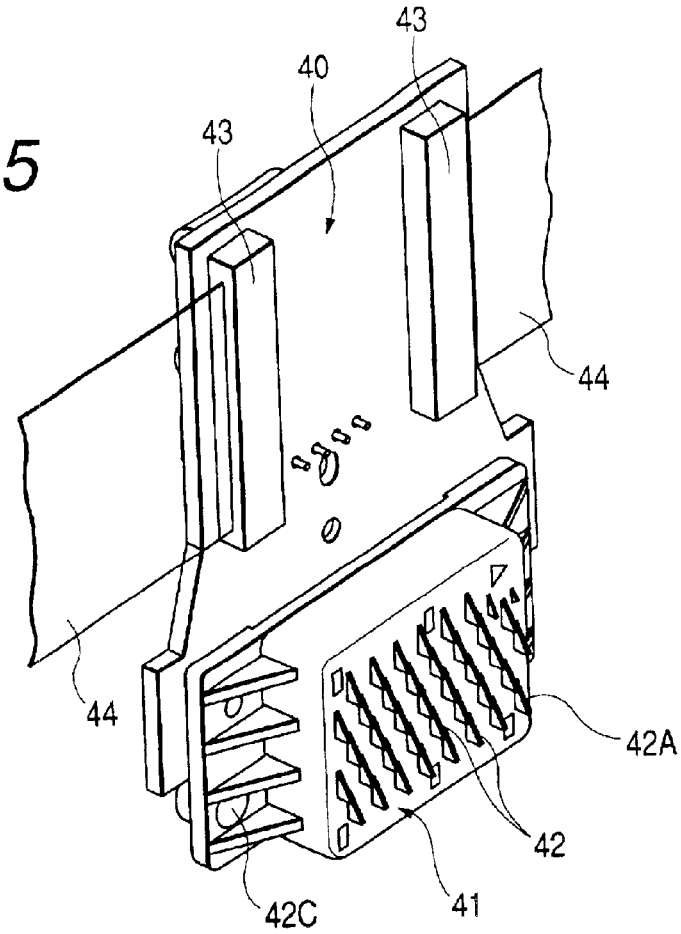
FIG. 5 is a perspective view that schematically shows the carriage base plate installed on the carriage represented in FIG. 1, observed from the recording head side.
Figure 6:
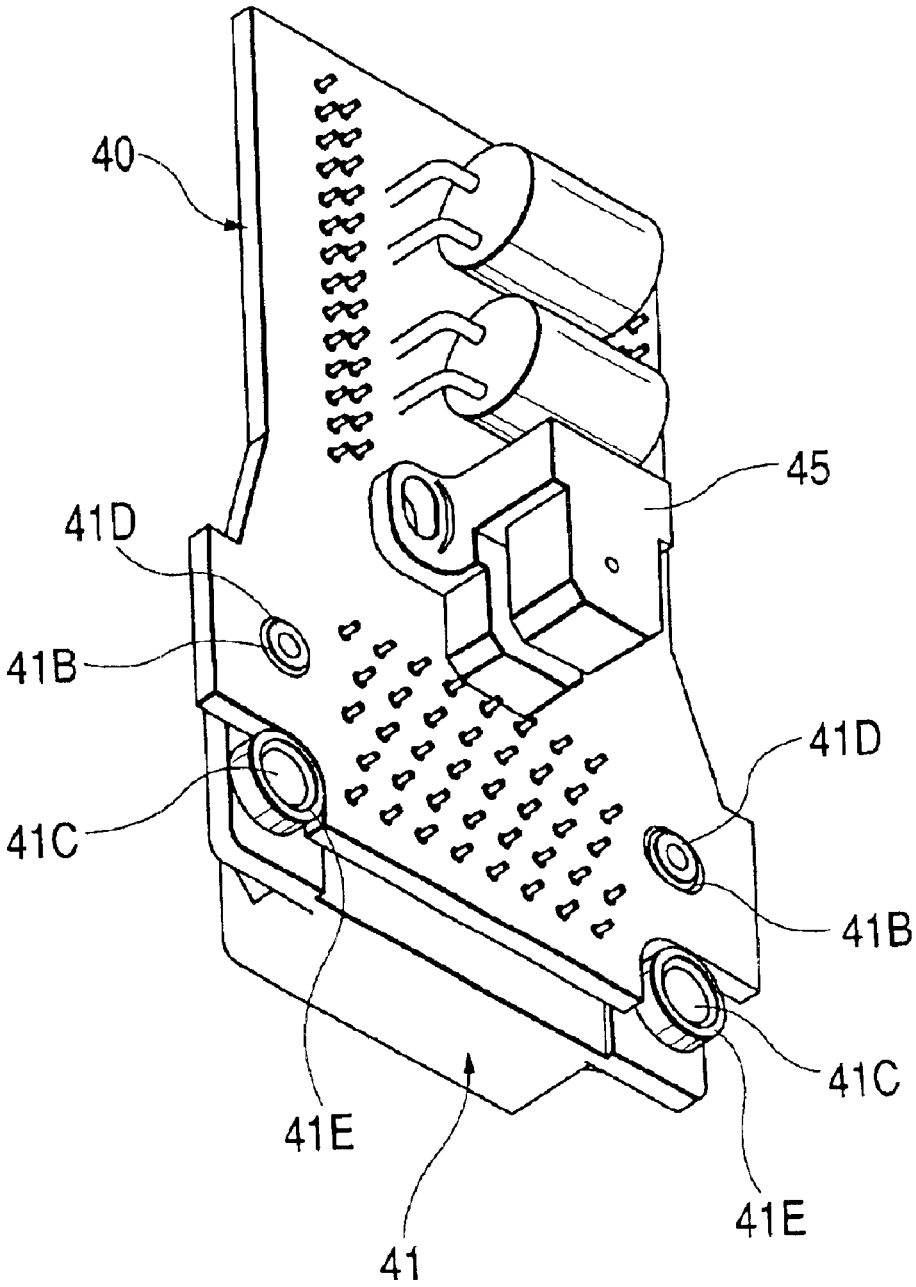
FIG. 6 is a perspective view that schematically shows the carriage base plate represented in FIG. 5, observed from the side opposite to the recording head.

FIG. 5 is a perspective view that schematically shows the carriage base plate 40 installed on the carriage 20, observed from the recording head 100 side (fixing face side of the recording head). FIG. 6 is a perspective view that schematically shows the carriage base plate 40 represented in FIG. 5, observed from the side opposite to the recording head 100 (the side opposite to the fixing face of the recording head). In FIG. 5 and FIG. 6, the carriage base plate 40 is fixed to the head fixing face of the carriage 20, that is, the inner wall face adjacent to the recording head 100. Then, the pressurized connector 41 is installed on the carriage base pate 40 on the head fixing face side.

For the pressurized connector 41, the pressurized pin 42 formed of metal is provided in a state of penetrating the connector. Each pressurized pin 42 is soldered to the carriage base plate 40 on the side opposite to the head fixing face (the surface pressed to be in contact with the contact face 111 of the head base plate 110 of the recording head 100). The pressurized contact face 42A of each pressurized pin 42 is in contact under pressure with the contact face 111 of the head base plate 110, hence materializing the condition in which the electrical coupling is possible between the recording apparatus main body and the recording head.

Further, for the pressurized connector 41, there are provided the boss 41B for positioning to the carriage base plate 40 and the positioning hole 41C for positioning to the carriage 20. The top face 41D of the boss 41B and the end face 41E of the positioning hole 41C are the faces (pressure supporting faces) to receive by the carriage 20 the reaction force of the pressurized pin 42 to be in contact under pressure with the recording head 100. For example, the numbers of pressurized pins 42 are 40 in accordance with the present embodiment, and when the recording head 100 is set to the carriage 20, the maximum load (contact pressure) of approximately 100 g is exerted per pin. The depressing load of approximately 4 kg in total acts upon the top face 41D of the boss 41B of the pressurized connector 41 and the end face 41E of the positioning hole 41C eventually. Also, as shown in FIG. 5, the FFC connector 43 is formed for the carriage base plate 40 to enable the FFC 44 to be inserted and coupled. Further, as shown in FIG. 6, the linear encoder 45, which detects the position of the carriage 20 in cooperation with the linear scale 55 shown in FIG. 1, is fixed by soldering or the like to the face on the side of the carriage base plate 40 opposite to the recording head 100 (which is observed from the side opposite to the head fixing face).

FIG. 7 is a perspective view that schematically shows the details of the carriage 20. In FIG. 7, on the upper face of the carriage 20, the flat spring 21 is installed to fix the recording head by hooking it to the rib 112 on the upper part of the recording head 100. In other words, the structure is arranged such that with the operation of the set lever 35, the flat spring 21 is elastically deformed in the retracting direction to draw the recording head 100 into the carriage 20, and after that, the flat spring 21 is released to fix the carriage 20 to the recording head 100 by hooking it to the rib 112 of the recording head 100.

The boss 20C on the upper end face of the carriage 20 is the one that axially supports the gap adjustment lever 90 rotatively. The gap adjustment lever 90 is axially supported on the boss 20C to be able to rotate. As shown in FIG. 7, the gap adjustment lever 90 can rotate in the direction indicated by an arrow V, and if the gap adjustment lever 90 rotates to the position at V1, the surface 90A of the gap adjustment lever 90 is made slidable with the guide rail portion 81 of the chassis 80. On the contrary, if it rotates to the position V2, the surface 90B of the gap adjustment lever is made slidable on the face of the guide rail portion 81. The surface 90A and surface 90B are at different distances from the center of the boss 20C. Therefore, with the rotation of the gap adjustment lever 90, the carriage 20 rotates centering on the guide shaft 50. As a result, the gap between the discharge port surface 81 of the recording head 100 mounted on the carriage 20 and the surface of a recording sheet (distance between the surface of recording sheet and the discharge port surface) is made changeable.

The face 20D formed for the carriage 20 is the face that is in contact under pressure with the positioning face (abutting face) 106 provided on the upper part of the recording head 100 in the direction Y (–) (forward and backward directions); the face 20E formed for the carriage 20 is the face that is in contact under pressure with the positioning face (abutting face) 105 in the direction Z (upward and downward directions) provided on the lower part of the recording head 100; the face 20F formed for the carriage 20 is the face that is in contact under pressure with the positioning face (abutting face) 104 provided on the upper part of the recording head 100 in the direction Y (+) (forward and backward directions); the face 20G formed for the carriage 20 is the face that is in contact under pressure with the positioning face (abutting face) 103 provided on the lower part of the recording head 100 in the direction X (left and right directions). Also, the holes 20H formed on the left and right of the carriage 20 are axial holes to axially support the left and right bosses 35A of the set lever 35 rotatively. The holes 20I formed on the left and right of the carriage 20 are the cover fixing holes that fit into the left and right bosses 30B of the carriage cover 30 for fixing the carriage cover 30 to the carriage 20.

The bosses 20B formed on the two locations, left and right, of the carriage 20 are those fitted into the positioning holes 41C of the pressurized connector 41 to position the pressurized connector 41 in the direction X (left and right directions) and direction Z (upward and downward directions) with respect to the carriage 20. The faces 20A formed on the two locations, left and right, of the carriage 20 are those against which the top face 41D of the boss 41B formed for the head connector and the end face 41E of the positioning hole 41C are arranged to abut. The top face 41D, the end face 41E, and face 20A are pressed to each other by the reaction force exerted by the pressurized contact with the contact pins 42 of the recording head 100, and constitute the abutting faces to position the head connector 41 to the carriage 20 in the direction Y (forward and backward directions).

Figure 8:
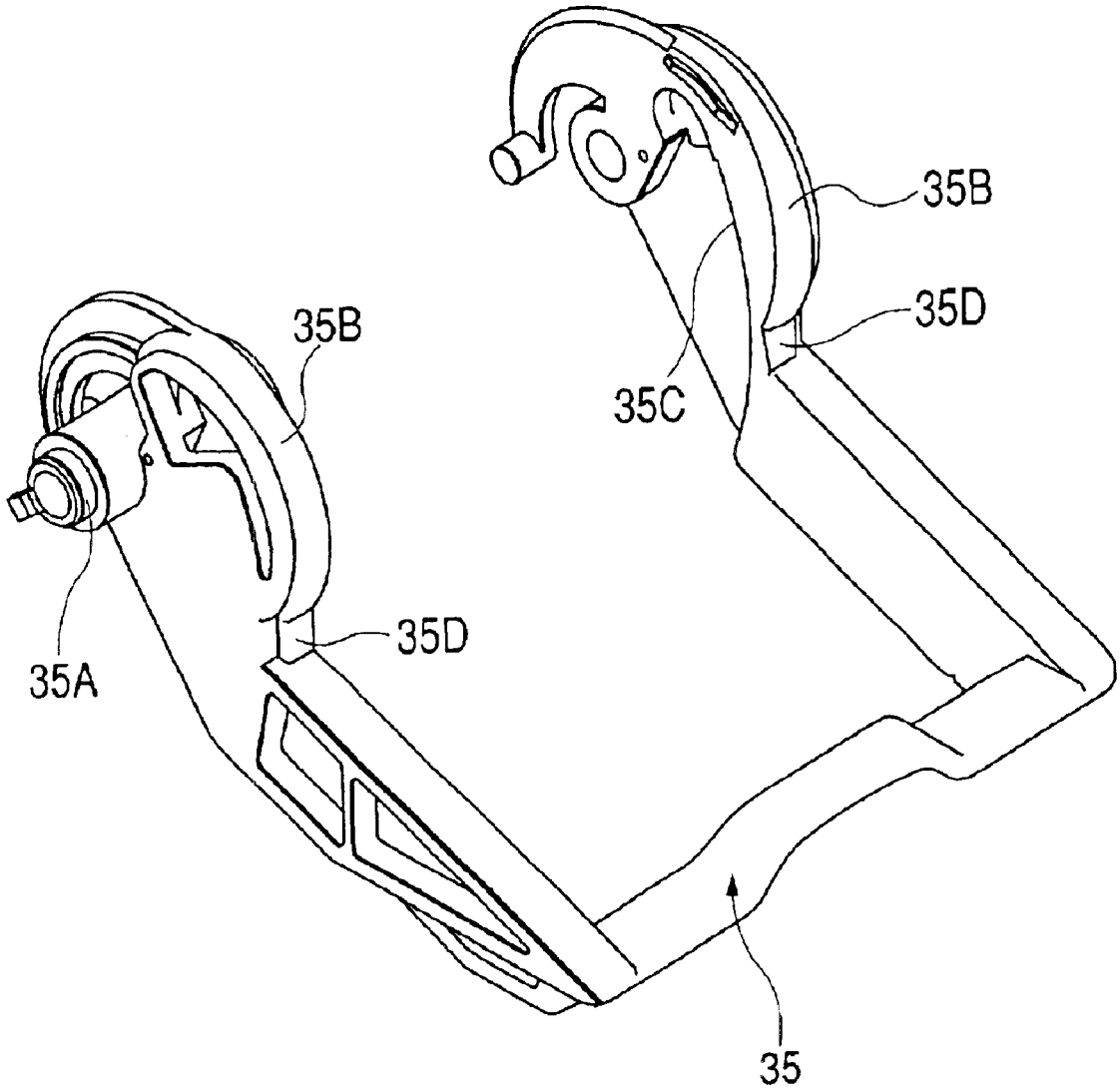
FIG. 8 is a perspective view that schematically shows a set lever rotatively fixed to the carriage represented in FIG. 7.

FIG. 8 is a perspective view that schematically shows the details of the set lever 35. In FIG. 8, the bosses 35A, which fit into the axially supporting holes 20H formed on the left and right of the carriage 20, are formed on the left and right of the set lever 35. The set lever 35 is, therefore, axially supported rotatively centering on the axially supporting holes 20H of the carriage 20. Also, on the left and right of the set lever 35, there are arranged a first cam (cam face) 35B for elastically deforming the flat spring 21 in the retracting direction, and a second cam (cam face) 35C for setting the recording head by drawing it into the carriage 20 with the slidable engagement with the left and right bosses 101 of the recording head 100. Also, the bosses 35A, the first and second cams 35B and 35C are all formed on both sides of the set lever 35, respectively. Further, for each end portion of the first cams (cam faces) 35B on both sides of the set lever 35, the recess 35D, with which the extrusion of the flat spring 21 fixed to the carriage 20 is able to engage, is formed.

Figure 9:
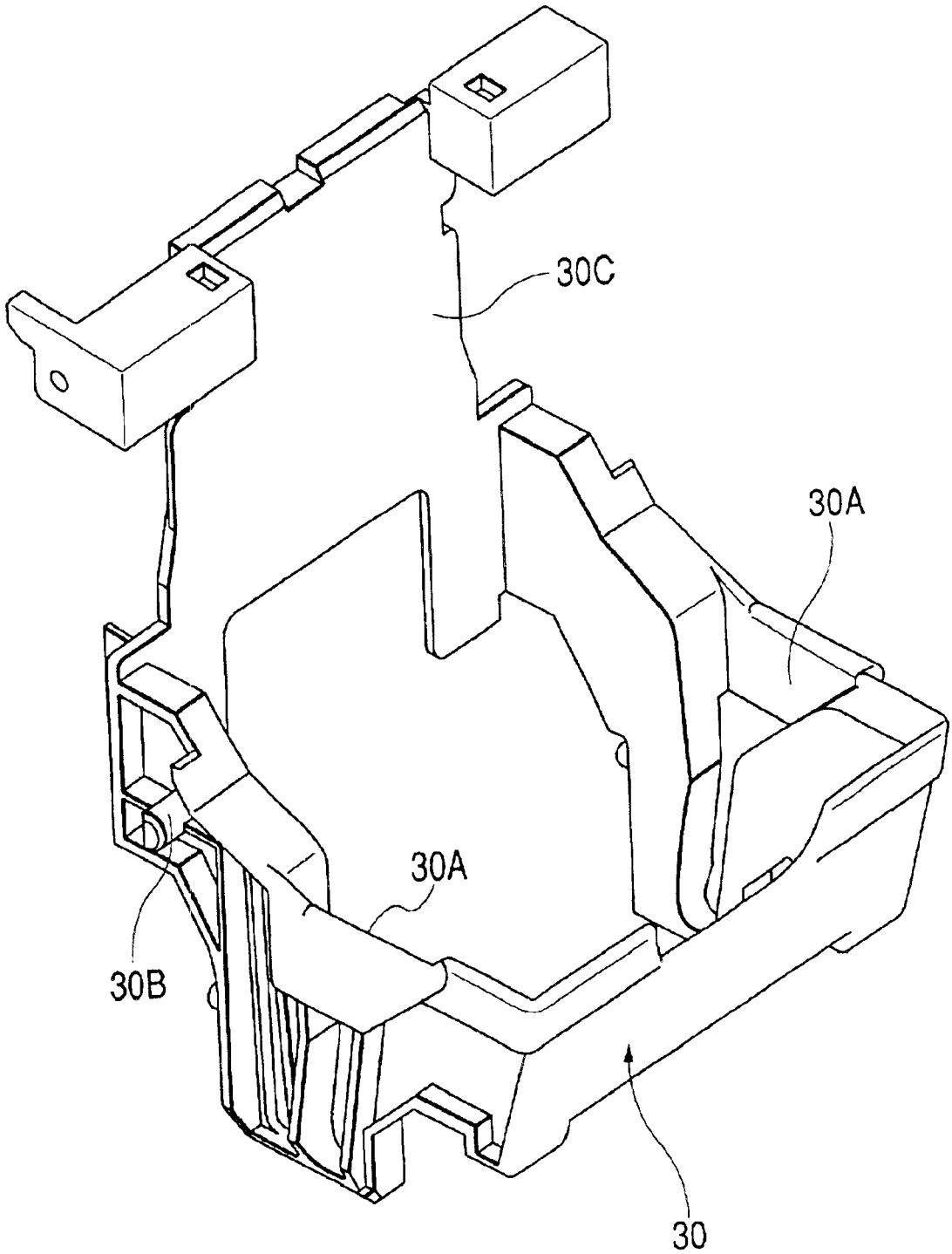
FIG. 9 is a perspective view that schematically shows a carriage cover fixed to the carriage represented in FIG. 7, observed from the outer side (backside, front side).
Figure 10:
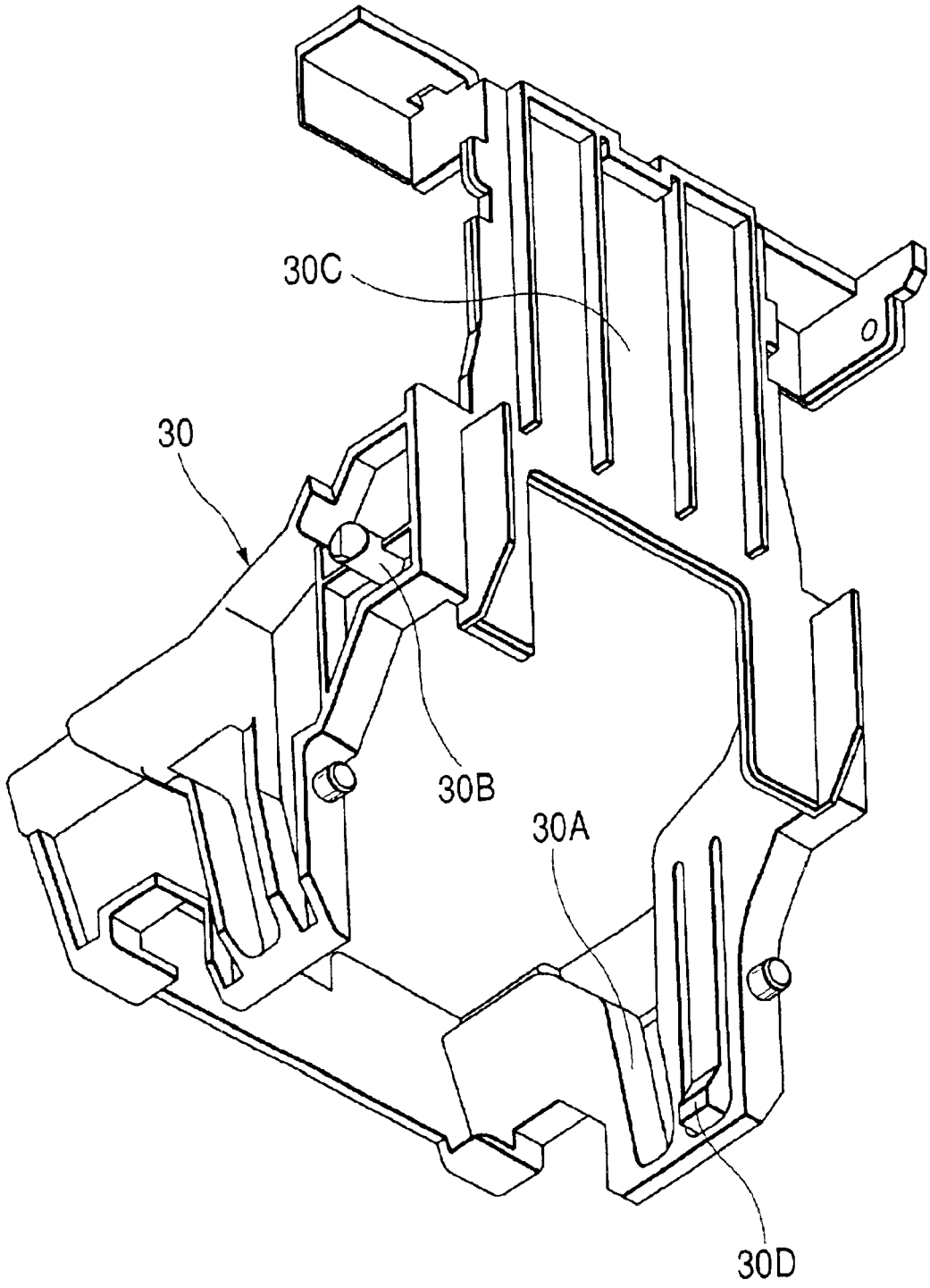
FIG. 10 is a perspective view that schematically shows the carriage cover represented in FIG. 9, observed from the inner side (rear side).

FIG. 9 is a perspective view that schematically shows the carriage cover 30 fixed to the carriage 20, observed from the outer side (backside, front side). FIG. 10 is a perspective view that schematically shows the carriage cover 30 represented in FIG. 9, observed from the inner side (rear side). With reference to FIG. 9 and FIG. 10, the carriage cover 30 will be described in detail.

In FIG. 9 and FIG. 10, on both sides of the inner face of the carriage cover 30, the groove portions 30A are formed as guiding sections to guide the elongated hole bosses 102, which are formed on the left and right of the recording head 100, and engage with these grooves. Also, on both sides of the carriage cover 30, there are formed the bosses 30B that fix the carriage cover to the carriage by fitting into the cover fixing holes 20I formed on the left and right of the carriage 20. Further, for the carriage cover 30, there are formed integrally the carriage base plate 40, and the wall-face type blindfolding portion 30C to blindfold portions at FFC 44 and head base plate 110, while protecting them (or protecting them from being exposed). Also, on the lower part of one side of the carriage cover 30, there is integrally formed an elastic portion 30D to press the recording head 100 to one direction of X (left and right directions) when the recording head is mounted.

Figure 11:
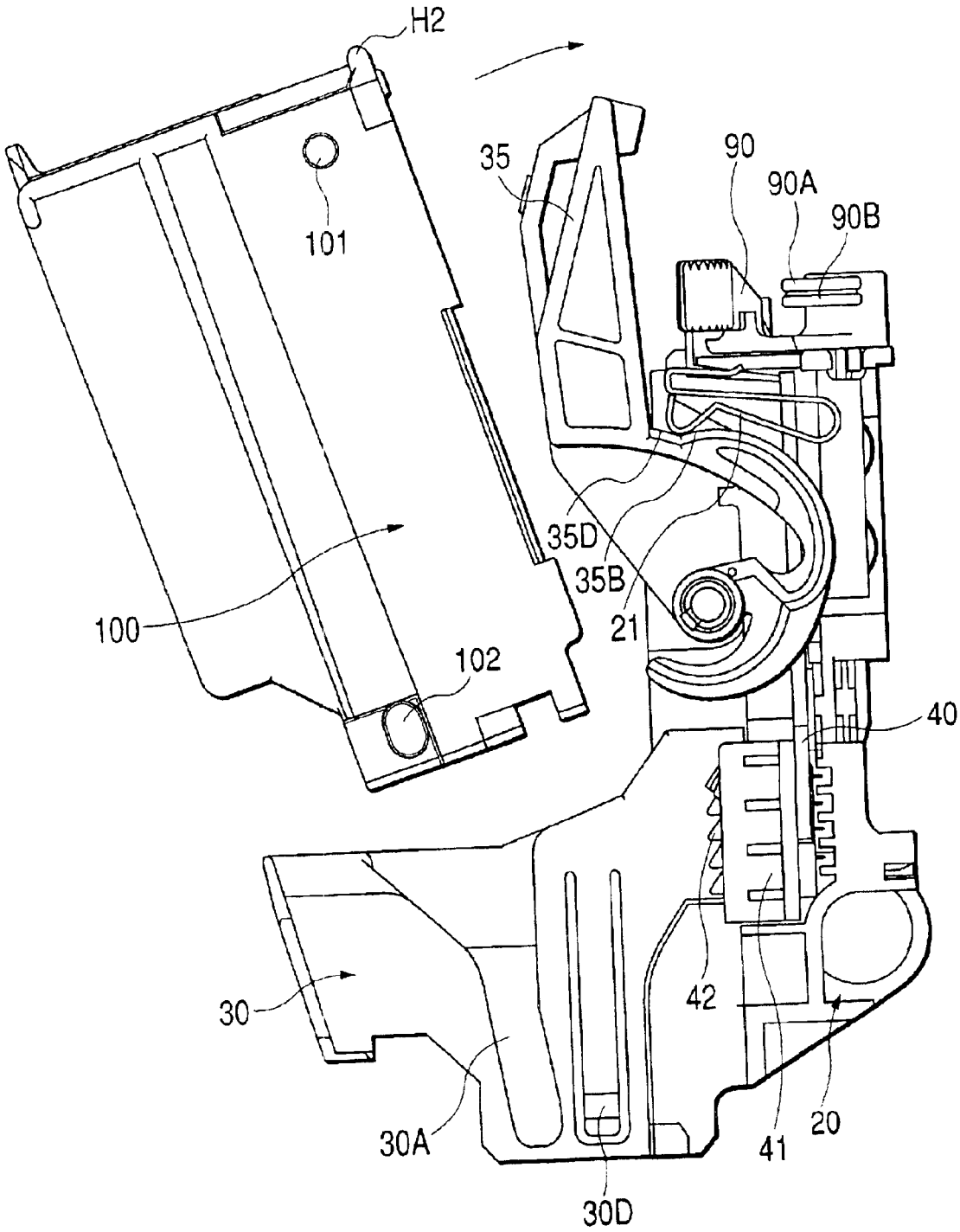
FIG. 11 is a sectional side view that schematically shows the state where a set lever is retracted upward before the recording head is inserted into the carriage in the carriage structure of one embodiment of the ink jet recording apparatus embodying the present invention.
Figure 12:
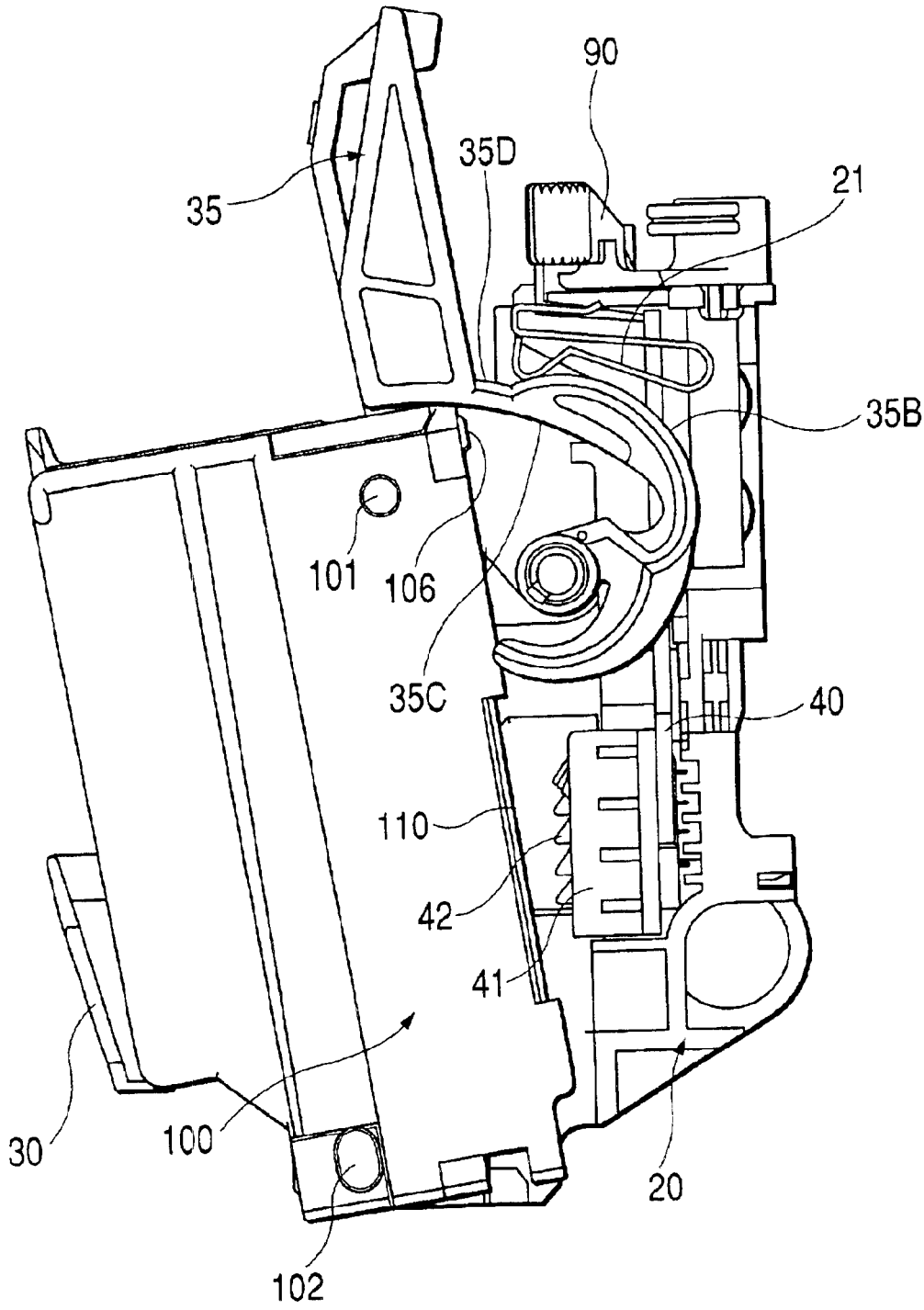
FIG. 12 is a sectional side view that schematically shows the state where the recording head is inserted from the state represented in FIG. 11 with the guiding portion of the carriage cover as a guide.
Figure 13:
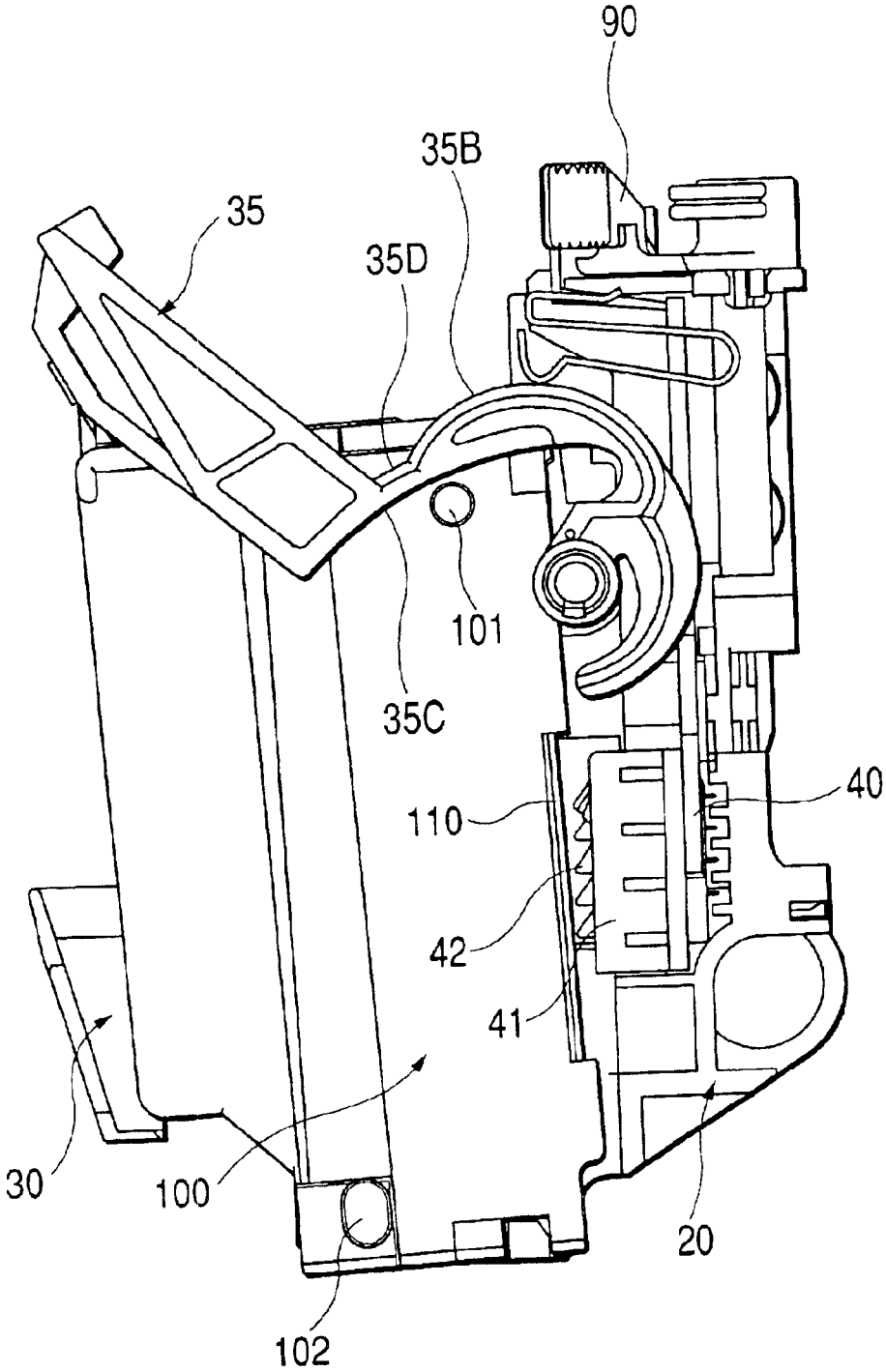
FIG. 13 is a sectional side view that schematically shows the state where the set lever rotates downward from the state represented in FIG. 12 to draw the recording head into the set position.
Figure 14:
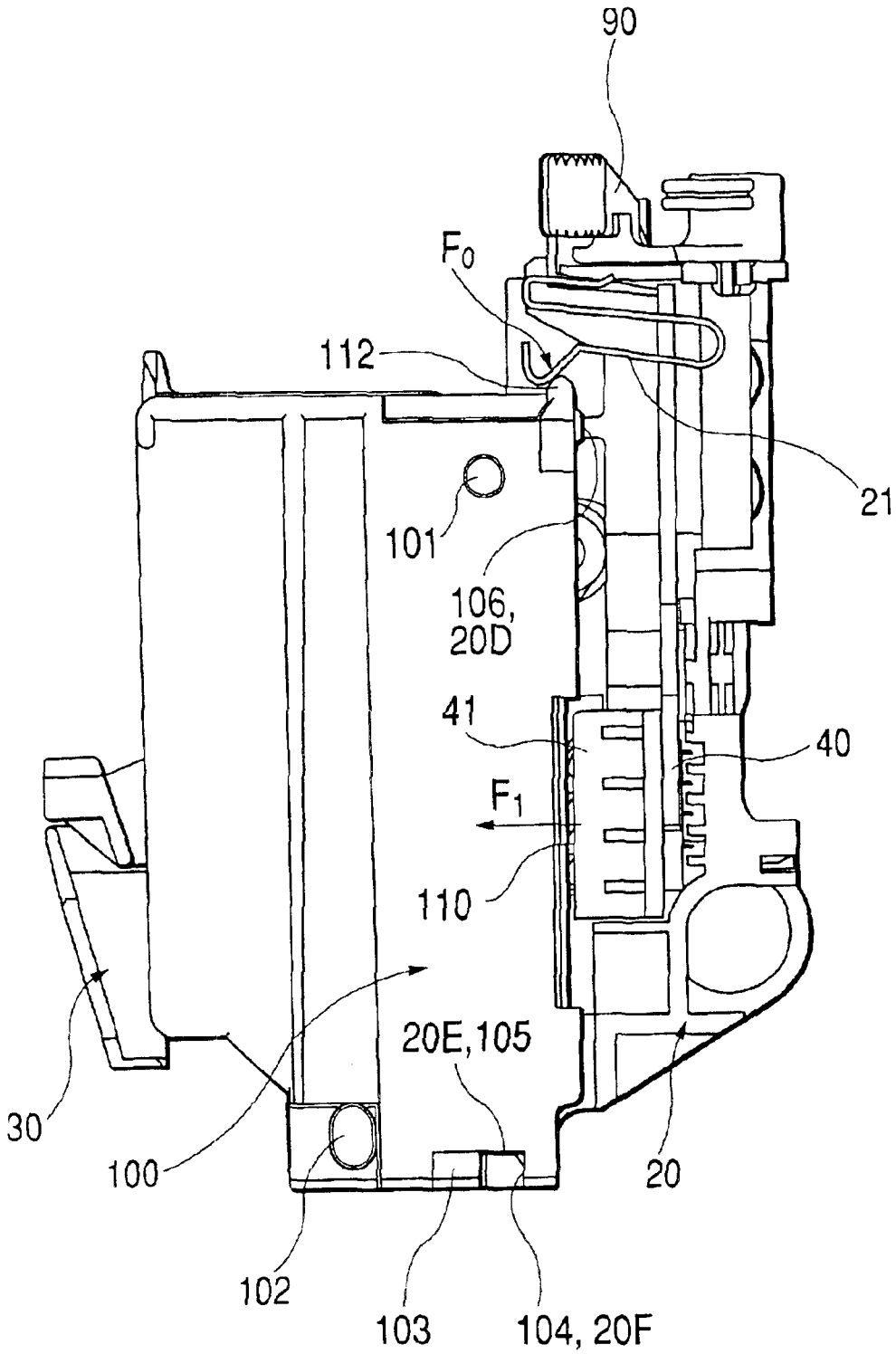
FIG. 14 is a sectional side view that schematically shows the state where the recording head is positioned and installed on the set position of the carriage in the carriage structure represented in FIG. 11.
Figure 15:
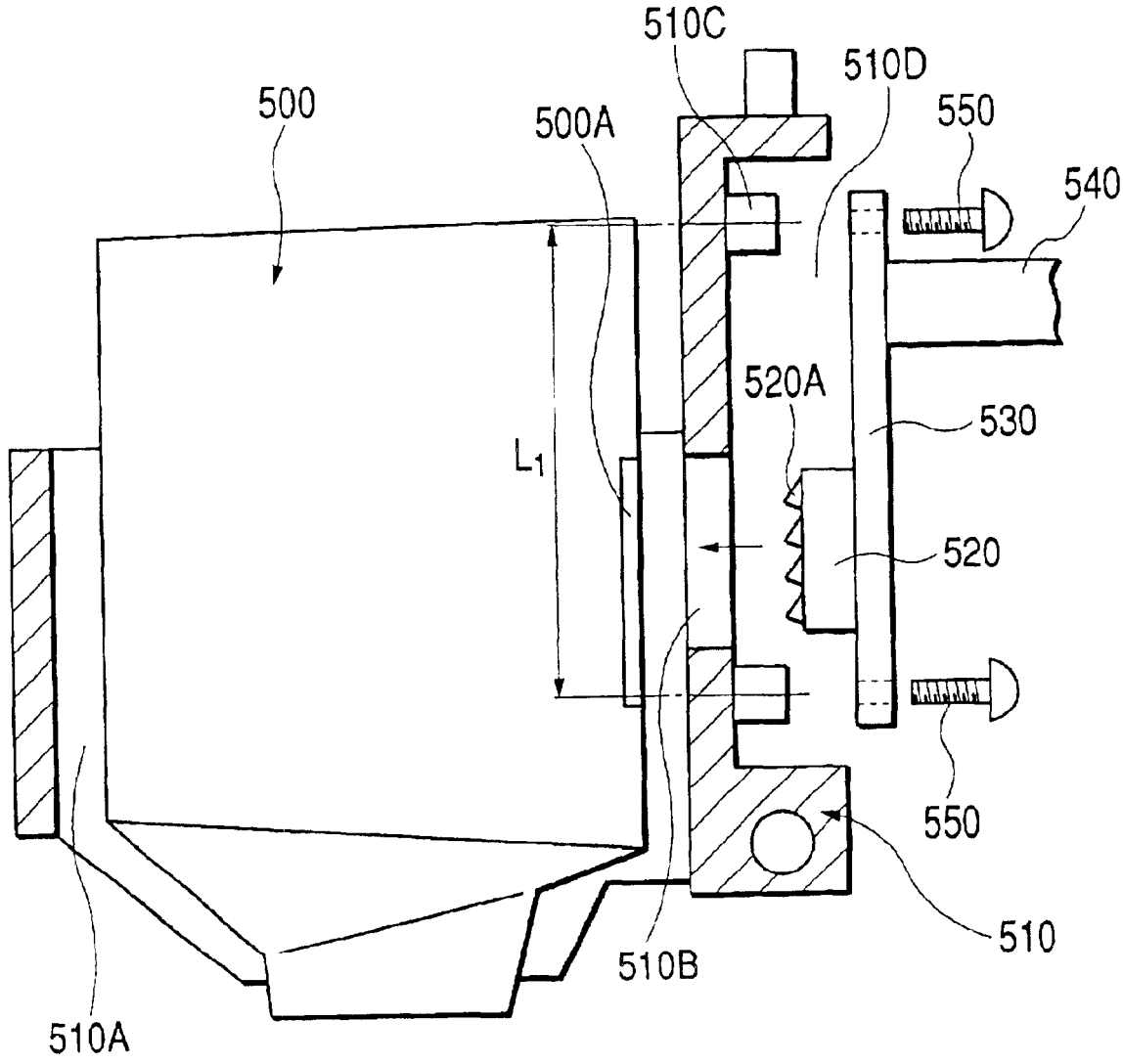
FIG. 15 is a vertically sectional view that schematically shows the example of the carriage structure of the conventional ink jet recording apparatus.

FIG. 11 to FIG. 14 are side views that schematically illustrate the operations of each part one after another when the recording head 100 is set to the carriage 20. FIG. 11 shows the state where the set lever 35 is retracted upward immediately before the recording head 100 is inserted into the carriage 20. FIG. 12 shows the state where the recording head 100 is inserted with the guiding portion of the carriage cover 30 as a guide. FIG. 13 shows the state where the set lever 35 rotates downward to draw the recording head 100 into the set position in the carriage 20. FIG. 14 shows the state where the recording head 100 is positioned and installed on the set position of the carriage 20.

Hereunder, with reference to FIG. 11 to FIG. 14, the description will be made of the operation to set the recording head 100 to the carriage 20.

As shown in FIG. 11, the user rotates the set lever 35 upward at first (in the direction indicated by an arrow). Then, the flat spring 21 fixed to the carriage 20 is elastically deformed in the retracting direction (upward) by means of the first cam 35B of the set lever 35. Also, for the set lever 35, the recess 35D formed on the end portion of the first cam 35B engages with the extrusion of the flat spring 21 as shown in FIG. 11 to FIG. 14, and the set lever 35 can be suspended (held) at the rising position in FIG. 11. In this state shown in FIG. 11, the recording head 100 is inserted. Then, the recording head 100 is allowed to drop down by its own weight, too, and inserted to the lower position as shown in FIG. 12, while the elongated hole bosses 102 are being guided by the left and right guiding portions (grooves) 30A of the carriage cover 30.

Then, as shown in FIG. 13, when the set lever 35 is being depressed, the second cams 35C on the left and right of the set lever draw in the bosses 101 on the left and right upper portions of the recording head 100 to move the recording head 100 in the carriage 20 direction. At the same time, then, the leading ends of the flat springs 21 fixed to the left and right of the carriage 20, begin to return gradually downward by the elasticity thereof by means of the first cams 35B provided for the left and right of the set lever 35. Subsequently, after the rib 112 on the upper end of the recording head 100 passes the leading end of the flat spring 21, the flat spring 21 depresses the rib 112 of the recording head at this time as shown in FIG. 14 to depress the recording head downward. At this juncture, the flat spring 21 retracts from the first cam 35B of the set lever 35.

With the operation that has been described above, the recording head 100 is positioned and installed on the carriage 20 as shown in FIG. 14.

In the state of installation as shown in FIG. 14, the recording head 100 receives the external force F0 from the flat spring 21, while receiving the contact reaction force F1 from the pressurized connector 41 as represented therein. The acting directions of these forces F0 and F1 are substantially as those shown in FIG. 14. Then, on each positioning face (each abutting face) of the recording head 100 and carriage 20, the recording head is depressed and positioned in conditions given below in the direction X (left and right directions), direction Y (forward and backward directions), and direction Z (upward and downward directions).

In other words, in the direction Y (forward and backward directions), positioning is made by the abutting contact of the abutting face 104 of the recording head 100 and the face 20F of the carriage 20, as well as by the abutting contact of the abutting face 106 of the recording head and the face 20D of the carriage. In the direction Z (upward and downward directions), positioning is made by the abutting contact of the abutting face 105 of the recording head and the face 20E of the carriage. Also, in the direction X (left and right directions), positioning is made when the abutting face 103 provided for one side of the recording head abuts against the face 20G of the carriage 20 with the rotation of the set lever 35 for installing the recording head, which enables the elastic portion 30D of the carriage cover 30 to depress (depress and bias) the recording head 100 only one directionally in the direction X.

In accordance with the embodiment described above, it is possible to fix the recording head 100 to the carriage 20 reliably with a smaller number of parts, and also, to obtain the carriage structure of the ink jet recording apparatus capable of holding the contact pressure of the pressurized connector 41 with the entire robustness of the carriage.

In other words, for the carriage 20 provided with the carriage base plate 40 having the pressurized connector 41 attached thereto, the pressurized connector 41 is installed on the wall face of the carriage 20 on the fixing face side of the recording head 100 (the fixation of the pressurized connector 41 to the carriage 20 being made on the recording head fixing face of the carriage), hence making it possible to hold the contact pressure of the pressurized connector 41 with the robustness of the carriage entire body. As a result, the thickness of the carriage 20 can be made thinnest, among some advantages, which leads to making the carriage smaller. Also, the method for holding the pressurized connector 41 on the carriage 20 does not require any tightening means, such as screws, by the utilization of the contact pressure of the pressurized connector 41, leading to the reduction of manufacturing costs.

Also, with the integration of the cover that hides the carriage base plate 40 (or prevents it from being exposed) and the guiding member at the time of recording head insertion (that is, the provision of the carriage cover 30), it becomes possible to simplify the configuration of the carriage single body, hence obtaining an advantage that the carriage can be processed with ease.

Here, it is to be understood that the present invention is not necessarily limited to the structure provided with the recording head 100 and the ink tanks 180 and 190 shown by the embodiment described above. The invention is equally applicable to a recording apparatus that uses one piece of recording head, a color recording apparatus that uses plural recording heads for recording with ink of different colors, or a gradational recording apparatus that uses plural recording heads for recording in one and same color but in different densities, and capable of attaining the same effects. Further, the invention is equally applicable to a recording apparatus structured by the combination thereof, and capable of obtaining the same effects.

Further, the present invention is equally applicable to the structure that uses an exchangeable ink cartridge, which is integrally formed by a recording head and ink tank, the structure having an ink head and ink tank separately and connecting them by tube or the like for use of ink supply, or the like, irrespective of the arrangement structure of the recording head and ink tank, and capable of obtaining the same effects. Here, the present invention is applicable to the ink jet recording apparatuses including the one that uses the recording head provided with electromechanical converting element, such as piezoelectric element. Of these apparatuses, the invention demonstrates excellent effects particularly when it is applied to a recording head that adopts the method for utilizing thermal energy for discharging ink, because with such method it is possible to attain recording in higher density and higher precision.

Further, for the present invention, the description of the embodiment has been made exemplifying the ink jet recording head as the recording head thereof, but the invention is applicable even to a recording head of the type that the head is in contact with a recording material like the thermal head or to a recording head of the type that a recording material is given impactive hits like the wire-dot head.

As obvious from the above description, the present embodiment makes it possible to reliably fix a recording head to a carriage with a smaller number of parts and simpler structure at a lower cost, and also, to receive the contact pressure of the pressurized connector with the robustness of the carriage as a whole, hence providing an ink jet recording apparatus that can attempt to make the carriage smaller and lighter.

What is claimed is:

1. A recording apparatus for recording on a recording material by use of a recording head, said apparatus comprising:

a carriage for mounting a recording head;

a circuit board electrically connectable to the recording head, said circuit board being attached to a wall of said carriage on a side of said wall that faces the recording head and having a detection portion of an encoder for detecting a position of said carriage; and a pressurized pin provided on said circuit board, said pressurized pin being in contact with a contact face of the recording head mounted on said carriage.

2. A recording apparatus according to claim 1, wherein fixation of said circuit board to said carriage is made by contact pressure between said circuit board and said carriage.

3. A recording apparatus according to claim 1, wherein a carriage cover having a guiding portion for installing the recording head on said carriage is provided on said carriage.

4. A recording apparatus according to claim 3, wherein a hiding portion for hiding said circuit board is formed on said carriage cover along with said guiding portion.

5. A recording apparatus according to claim 1, wherein said recording head is an ink jet recording head for discharging ink from ink discharge ports.

6. A recording apparatus according to claim 5, wherein said ink jet recording head comprises an electrothermal converting element for generating thermal energy to be utilized for discharging ink.

* * * * *